United States Patent [19]

Higgins

[11] 4,180,877

[45] Jan. 1, 1980

[54] MATTRESS

[75] Inventor: Larry Higgins, Carthage, Mo.

[73] Assignee: Leggett & Platt, Incorporated, Carthage, Mo.

[21] Appl. No.: 944,914

[22] Filed: Sep. 22, 1978

[51] Int. Cl.[2] ..... A47C 23/02

[52] U.S. Cl. ..... 5/263; 5/267; 5/475; 5/478

[58] Field of Search ..... 5/254, 260–267, 5/277, 264, 351, 354

[56] References Cited

U.S. PATENT DOCUMENTS

| | | | |
|---|---|---|---|
| 793,853 | 7/1905 | Smith | 5/267 |
| 2,910,114 | 10/1959 | Levine | 5/269 |
| 3,165,761 | 1/1965 | Ross | 5/351 |
| 4,101,992 | 7/1978 | Levine et al. | 5/260 |

*Primary Examiner*—Casmir A. Nunberg
*Attorney, Agent, or Firm*—Wood, Herron & Evans

[57] ABSTRACT

A mattress having increased firmness in a preselected area on both sides of the mattress through use of a welded wire grid structure attached to the opposite sides of the mattress. In one preferred form, the increased firmness is provided only in a preselected area, e.g., the center one-third area of the mattress, by a welded wire grid while in another preferred embodiment, the grid wires extend over the complete area of the mattress. The wire grids are preformed and assembled as a separate subassembly and are attached to the preassembled spring core by conventional connectors, as for example, conventional hog rings.

7 Claims, 4 Drawing Figures

MATTRESS

This invention relates to spring units. More particularly, this invention relates to mattresses.

Bedding spring units such as mattresses are generally fabricated of a plurality of individual springs, e.g., coil springs, organized in matrix-like fashion into columns and rows. These springs are held in spatial relation relative one to the other, i.e., the rows and columns of the matrix are restrained in fixed relation relative one to the other, in the finished mattress by some type of fastener device that interconnects adjacent springs throughout the matrix one with the other. After fabrication of the spring unit itself, manufacture of the finished mattress product is completed by placing a cushion or pad of material, e.g., woven or nonwoven batting, or foam rubber, or the like, over the top and the bottom surfaces of the spring unit matrix so formed. The padded structure is then enclosed with an upholstered fabric or cloth sheet or the like to provide the saleable mattress product.

In the bedding industry, i.e., in the mattress and box spring industry, customer demand and preference in recent years has been for greater firmness in both mattresses and supporting box springs. There are a couple of different basic approaches which have been used to increase the firmness of a mattress or box spring. One approach is simply to increase the number of springs within the unit. Another approach has been to increase the gauge from which th springs within the bedding are fabricated. However, both of these approaches result in increased fabrication costs; in the first instance because of the increased number of coils required in the spring unit, and in the second instance because of the increased wire gauge for each of the coils in the spring unit.

In connection with box springs only, a further approach that has been commercial use in recent years involves the use of a welded wire grid overlaid on the top surface only of the box spring, that welded wire grid having generally the same peripheral geometry and size as the spring unit itself. The box spring's welded wire grid is provided with a number of row wires generally equal to the number of spring rows in the unit, and a number of column wires generally equal to the number of columns in the unit, the column and row wires being welded one to another at all intersection or crossover points of those wires, thereby giving rise to the reference phrase of welded wire grid. The welded wire grid is connected to the top surface of the box spring by any suitable connectors known to the art.

It has been the primary objective of this invention to provide an improved mattress in which a preselected area of that mattress, on both sides of the mattress, may be provided with increased firmness, relative to the same area of that mattress if not so selected, through use of a novel wire grid structure.

In accord with this primary objective, it has been a further objective of this invention to provide an improved mattress in which a preselected surface area of the mattress is provided with a novel wire grid in which the majority of the crossover points of the grid wires are not connected, e.g., not welded, the non-welded wire grid being fixed to the preselected surface area of the mattress on each side of the mattress for increasing the firmness of the mattress in that preselected area on both sides of the mattress.

In accord with the objectives of this invention, the improved mattress of this invention has increased firmness in a preselected area on both sides of the mattress through use of the novel wire grid structure on both sides of the mattress. In one preferred form, increased firmness is provided in a preselected area, e.g., the edgemost portion of the mattress and in another preferred form, over the center one-third area of the mattress, by a separate novel wire grid in which the grid wires of the wire grid are welded at some of the crossover points but unconnected at the majority of the crossover points in that grid. As identical preformed wire grid is connected to each of both surfaces of the mattress by, e.g., hog rings.

Other objectives and advantages of this invention will be more apparent from the following detailed description taken in conjunction with the drawings in which.

Figure 1:
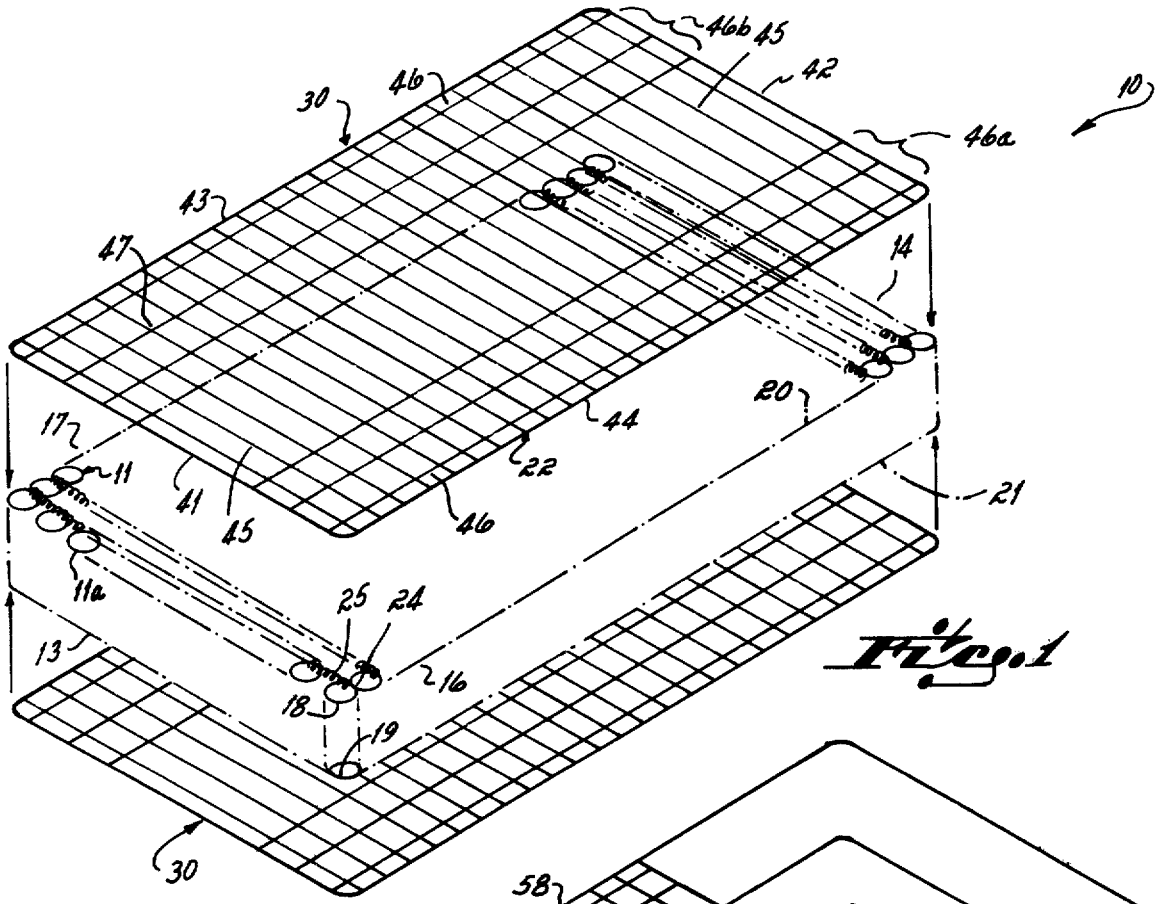
FIG. 1 is an exploded perspective view illustrating a first preferred embodiment of an improved mattress in accord with the principles of this invention, the mattress being of a single bed width.
Figure 2:
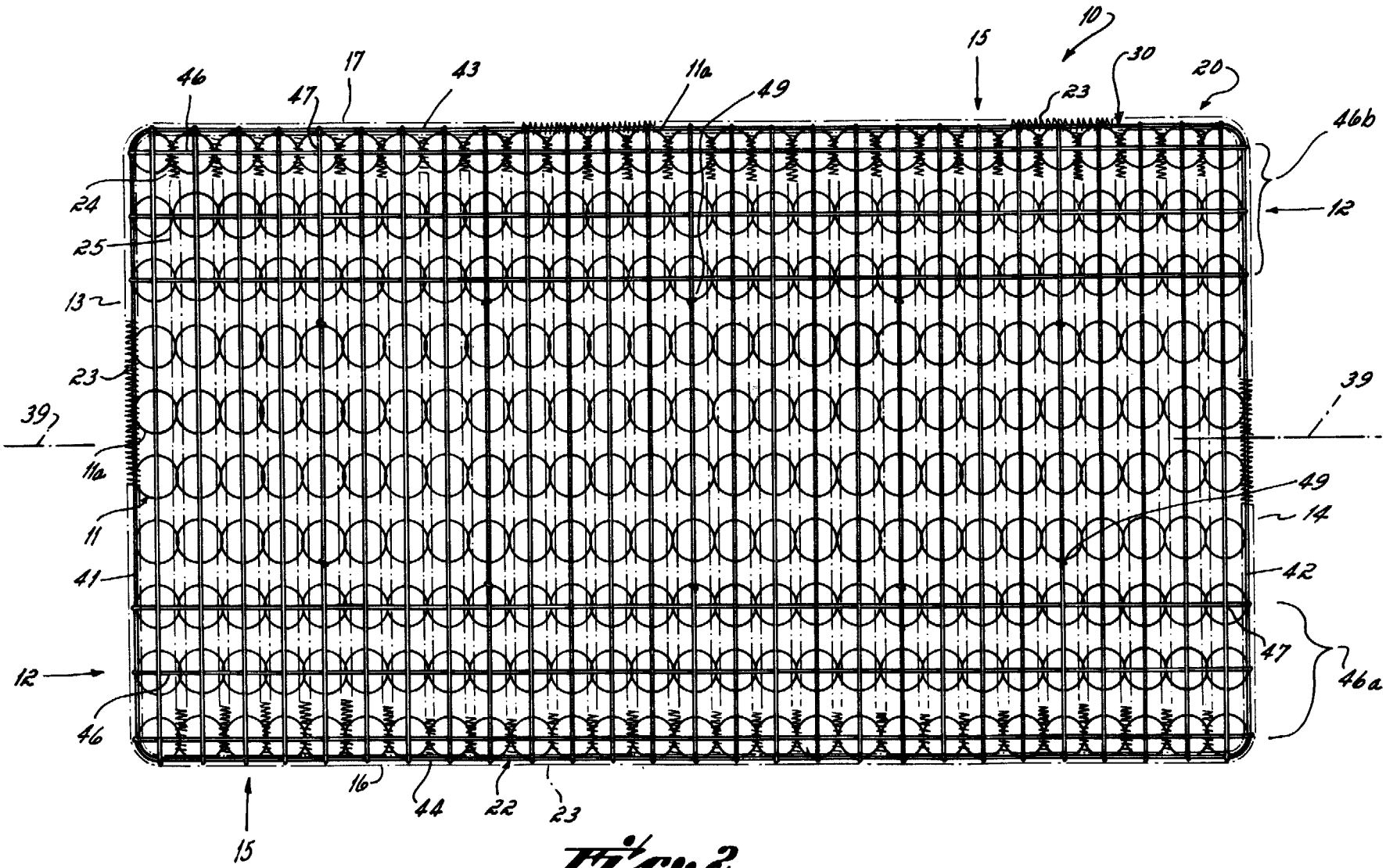
FIG. 2 is a top plan view illustrating a mattress as assembled from the exploded preformed component parts shown in FIG. 1.

A first embodiment of an improved mattress 10 in accord with the principles of this invention is illustrated in FIGS. 1 and 2. The mattress 10 is basically comprised of a number of coil springs 11 arranged in matrix like fashion, the coil spring matrix defining ten columns 12 extending from one end edge 13 to the other end edge 14 of the mattress, and twenty-seven rows 15 extending from one side edge 16 to the other side edge 17 of the mattress. The coil springs 11 illustrated are of the ordinary double cone or hourglass type (not shown in detail). Each of the coil springs 11 includes a circular top loop 18 and a circular bottom loop 19, all of the circular top loops being oriented in the same basic horizontal plane to define the top surface 20 of the mattress, and all the bottom loops being arranged in the same basic horizontal plane to define the bottom surface 21 of the mattress. Although FIG. 2 illustrates the top horizontal surface 20 of the mattress 10 only, it will be understood to those skilled in the art that the bottom surface 21 of the mattress is structurally identical to the top surface.

The matrix of coil springs 11 is connected together in matrix configuration in both the top surface and bottom surface of the mattress by connecting adjacent coil springs rows 15 together one with another. Two different spiral spring connectors 23, 25 are used in maintaining the multiple coil springs 11 in the matrix configuration. The first spiral spring connector 23 cooperates with the border coil springs 11*a* to define the periphery of the mattress spring assembly. The second spiral spring connector 25 connects adjacent coil springs 11 in adjacent rows 15 and, therefore, adjacent rows of springs, one with the other. More particularly, and for the top plane 20, the mattress border connector structure includes a mattress border wire 22 connected to border springs 11*a* in the spring assembly matrix. The mattress border wire 22 is simply a length of wire extending around the outer border periphery of the spring 11 matrix in the top plane 20 of the spring assembly matrix. The mattress border wire 22 is connected to the outer segments of the border springs' top loops 18 in the top plane 20 by the lacing wire 23 spirally wound around the border wire and the adjacent spring loop segments throughout the length of the border. The spring row connector 25 structure interconnects adjacent springs 11 of adjacent rows 15 throughout the top surface 20 of the mattress 10. In the spring row connector structure, the adjacent top coil loops 18 in adjacent spring rows 15 are overlapped one upon the other as at joints 24, and the spiral lacing wire 25 is extended from one end to the other of the adjacent rows, thereby interconnecting the adjacent coil springs in those adjacent rows at the overlapped joints. The helical lacing wires 25 may be tied to the border wire 22 at each end thereof by welding, or by being looped around the border wire, or otherwise. The bottom plane 21 of the mattress (not shown) is provided with the same border 23 and spring row 25 connector structures for the coil springs' bottom loops 19 in that bottom plane as has been described for the mattress' top plane 20.

The first preferred mattress embodiment, shown in FIGS. 1 and 2, includes a reinforcing wire grid structure 30 incorporated in both the top 20 and bottom 21 surfaces of the mattress, the wire grid structure 30 being identical for both of the top 20 and bottom 21 surfaces. As shown, the reinforcing wire grid structure 30 is sized to cover the entire surface area of each mattress surface 20, 21, i.e., is sized to cover that mattress surface area embraced by all coil spring rows 15 and all coil spring columns 12. The wire grid 30 is comprised of the grid border wire which is, in this embodiment, the same structural element as mattress border wire 22. The border wire 22 includes opposed end 41, 42 edge sections, and opposed side 43, 44 edge sections. Hence, and in this first embodiment, the spiral lacing wire 23 that fixes the mattress border wire to the coil spring matrix also fixes the grid border wire (and, hence, the wire grid 30) to the coil spring matrix since the mattress and grid border wires are defined by the same structural border wire element 22.

The border wire 22 carries a plurality of transverse wires 45 between the side edge sections 43, 44, the number of such transverse wires shown being equal to the number of coil spring rows 15 embraced by the border wire. The transverse wires 45 are welded to the side edge sections 43, 44 of the border wire 22 to fixedly attach those grid wires 45 to the border wire. Further, the transverse grid wires 45 are aligned with the centerline of each transverse spring row 15. In addition to the transverse grid wires 45, a plurality of longitudinal grid wires 46 (relative to the longitudinal axis 39 of the mattress) are connected between top edge section 41 and bottom edge section 42 of the border wire 22. Although ten coil spring columns 12 are embraced within the reinforced surface area 20, 21, only six such longitudinal grid wires 45 are connected between top 41 and bottom 42 edge sections of the border wire 22. The six longitudinal grid wires 46 are subdivided into a right-hand set **46*a* and a left-hand set 46*b*, each of the three wires 46 of each set 46*a*, 46*b* overlying one of the three spring columns 12 adjacent the mattress' side edge 16 or 17. Note the longitudinal grid wires 46 are aligned with the centerline of each longitudinal spring row 12. The connections of the longitudinal grid wires 46 with the border wire 22 are also fixed by weldments. This allows each wire grid 30 to be handled as a preformed subassembly during manufacture of the mattress. However, and importantly relative to the useful life of this reinforcing wire grid 32 structure, none, some, or all of the crossover points 47 of the longitudinal grid wires 46 with the transverse grid wires 45 within the periphery defined by the border wire 41–44 may be fixedly connected one with another, i.e., may be welded one to the other. Randomly positioned hog rings 49 are used, in addition to spiral lacing wire 23, to retain the wire grid 30 in assembly with the coil spring matrix, the hog rings 49 cooperating with the top or bottom loops 18, 19 of the coil springs 11 and the transverse grid wires 45**.

Figure 3:
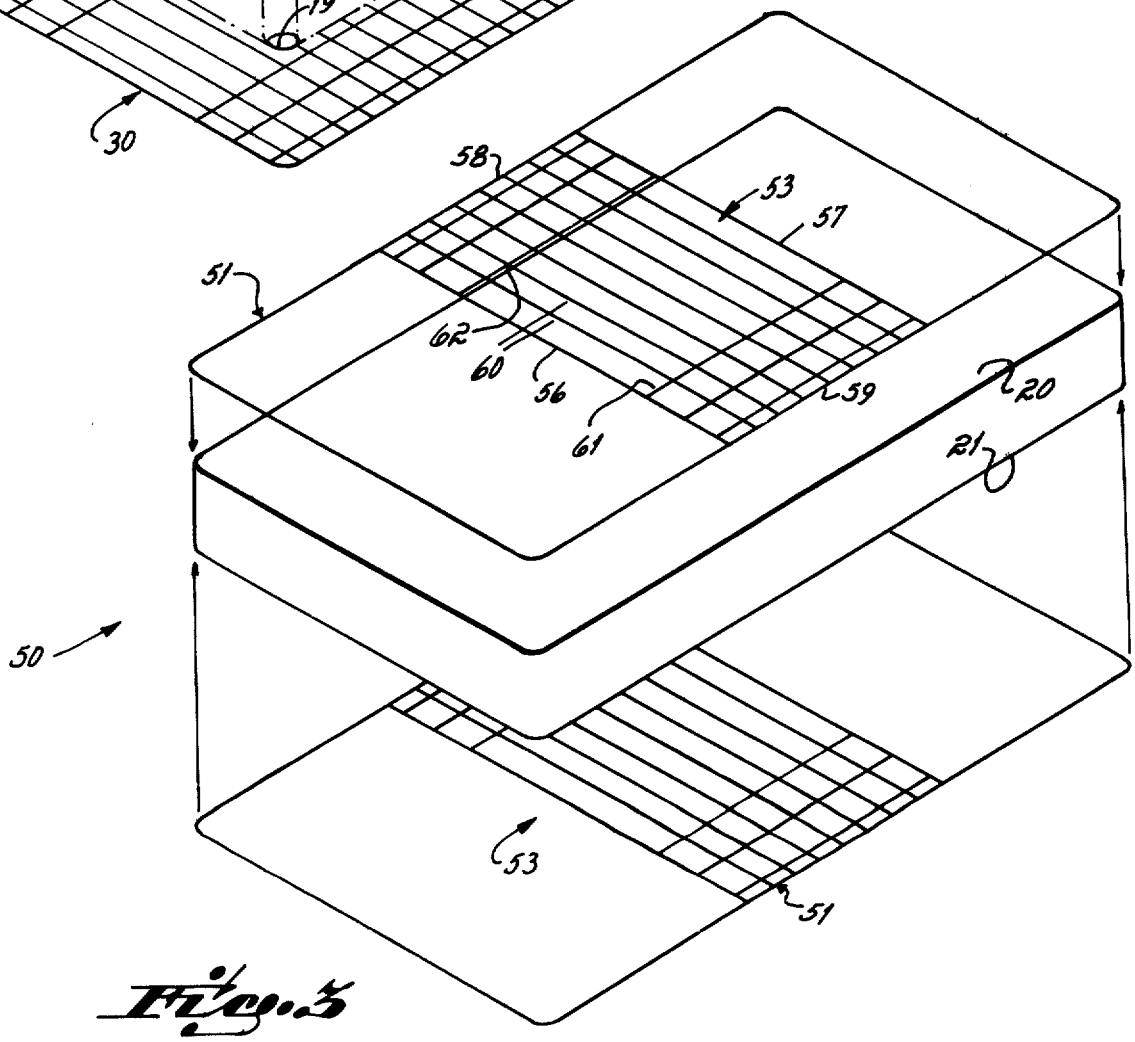
FIG. 3 is an exploded perspective view similar to FIG. 1, but illustrating a second preferred embodiment of a mattress fabricated in accord with the principles of this invention, the mattress being of a single bed width.
Figure 4:
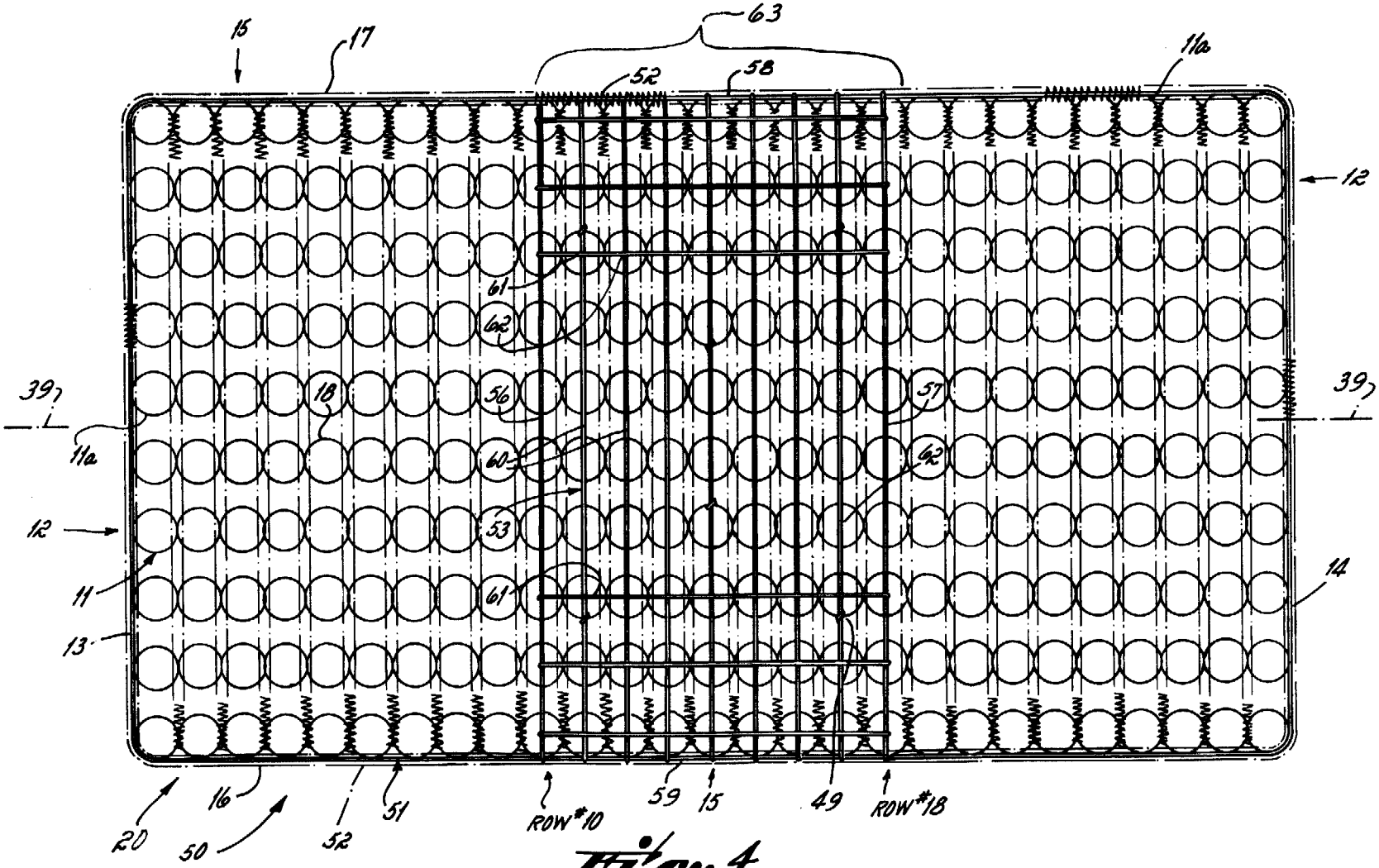
FIG. 4 is a top plan view of a mattress as assembled from the exploded preformed component parts shown in FIG. 3.

A second embodiment of an improved mattress 50 in accord with the principles of this invention is illustrated in FIGS. 3 and 4. In describing this second embodiment, like parts have been provided with the same reference numbers relative to the reference numbers for the FIGS. 1 and 2 embodiment. The mattress 50 is basically comprised of a number of coil springs 11 arranged in matrix-like fashion, the coil spring matrix defining ten columns 12 extending from one end edge 13 to the other end edge 14 of the mattress, and twenty-seven rows 15 extending from one side edge 16 to the other side edge 17 of the mattress. The coil springs 11 illustrated are of the ordinary double cone or hourglass type (not shown in detail). Each of the coil springs 11 includes a circular top loop 18 and a circular bottom loop, all of the circular top loops being oriented in the same basic horizontal plane to define the top surface 20 of the mattress, and all the bottom loops being arranged in the same basic horizontal plane to define the bottom surface 21 of the mattress. Although FIG. 4 illustrates the top horizontal surface 20 of the mattress 10 only, it will be understood to those skilled in the art that the bottom surface 21 of the mattress is structurally identical to the top surface.

As with the first embodiment, in this second embodiment the matrix of coil springs 11 is connected together in matrix configuration in both the top surface and bottom surface of the mattress by connecting adjacent coil springs rows 15 together one with another.

For the top plane 20, the mattress border connector structure includes a mattress border wire 51 connected to border springs **11*a* in the spring assembly matrix. The mattress border wire 51 is simply a length of wire extending around the outer border periphery of the spring 11 matrix in the top plane 20 of the spring assembly matrix. The mattress border wire 51 is connected to the outer segments of the border springs' top loops 18 in the top plane 20 by a lacing wire 52 spirally wound around the border wire and the adjacent spring loop segments throughout the length of the border. The bottom plane 21 of the mattress (not shown) is provided with the same border wire and border wire connector structures for the coil springs' bottom loops as has been described for the mattress' top plane 20**.

The second preferred mattress embodiment, as shown in FIGS. 3 and 4, includes a reinforcing wire grid structure 53 incorporated in both the top 20 and bottom 21 surfaces of the mattress, the wire grid structure 53 being identical for both of the top 20 and bottom 21 surfaces. As shown, the reinforcing wire grid structure 53 is sized to cover the middle one-third area of each mattress surface 20, 21, i.e., is sized to cover that mattress surface area 63 embraced by coil spring rows ten through eighteen and all coil spring columns 12 in that area. Since the center area of a mattress is subjected to the greatest stress over the mattress' useful life, that is one area where the reinforcement is useful to increase the overall firmness of the mattress to the user. The wire grid 53 is comprised of a plurality of transverse wires 60 which extend between the side edge sections 58, 59 of the border wire 51. The transverse grid wires 60 are welded or otherwise fixed to the side wire edge sections 58, 59 of the grid border wire 51 to fixedly secure those grid wires 60. Further, the transverse grid wires 60 are aligned with the centerline of each transverse spring row 15. In addition to the transverse grid wires 60, a plurality of longitudinal grid wires 61 (relative to the longitudinal axis 39 of the mattress) are connected between the endmost transverse grid wires. In the illustrated embodiment those endmost transverse grid wires have been designated by numerals 56 and 57. Although ten coil spring columns 12 are embraced within the reinforced center area 63, only six such longitudinal grid wires 61 are connected between the endmost transverse grid wires 56, 57. Note the longitudinal grid wires 61 are aligned with the centerline of each longitudinal spring column 12. It will be noted, therefore, that no longitudinal grid wires are provided in the centermost four coil spring columns. This arrangement provides a maximum support along the side edges of the mattress' center area 63, but less than maximum support in the longitudinal center portion of that center area. The connections of the longitudinal grid wires 61 with the endmost transverse wires are fixed by weldments. This allows each wire grid 53 to be handled as a subassembly during manufacture of the mattress. However, and importantly relative to the useful life of this reinforcing wire grid structure, none, some, or all of the crossover points 62 of the longitudinal grid wires 61 with the transverse grid wires 60 within the periphery of the wire grid structure 53 may be fixedly connected one with another, i.e., may be welded one to the other.

In addition to the wire lacing securing the border wire to the spring units, the welded wire grids 53 are preferably secured to the spring units by hog rings 49 which primarily serve to prevent the grid from moving relative to the springs and creating unnecessary noise.

The improved mattresses 10, 50 in accord with the principles of this invention, as illustrated in FIGS. 1–4, are shown as being of a single bed width. The principles of this invention are equally applicable to a mattress of a double bed width, however.

Having described in detail the preferred embodiment of my invention, what I desire to claim and protect by Letters Patent is:

1. An improved mattress comprising, a coil spring assembly including a plurality of coil springs arranged in a matrix configuration having a plurality of transverse coil spring rows and a plurality of longitudinal coil spring columns, said transverse rows and longitudinal columns of coil springs being interconnected by helical lacing wires, two wire grids sized to overlie a desired and preselected surface area of that coil spring matrix, one of said wire grids being located on the top surface of said mattress, and the other of said wire grids being located on the bottom surface of said mattress, each of said wire grids having a border wire and a plurality of grid wires welded to said grid border wire, each of said wire grids being constructed as a preformed subassembly prior to connection with said coil spring assembly, and said coil spring assembly being constructed as a preformed subassembly prior to connection with said wire grids, and connector means for connecting each of said wire grids to said coil spring assembly in said preselected area.

2. An improved mattress as set forth in claim 1, said grid wires being unconnected one to another at the majority of their crossover points.

3. An improved mattress as set forth in claim 1, said grid border wire being sized and configured so as to conform to the periphery of said mattress.

4. An improved mattress unit as set forth in claim 1, said wire grids being sized and configured to overlie the center one-third section of said coil spring matrix, said center section being disposed generally midway between end edges of said coil spring matrix and extending generally between side edges of said coil spring matrix.

5. An improved mattress as set forth in claim 1, said wire grids comprising a number of transverse wires equal to the number of transverse spring rows embraced by said wire grid and a number of longitudinal wires less than the number of longitudinal spring rows embraced by said wire grid.

6. An improved mattress as set forth in claim 1, each of said wire grids comprising at least one of (a) a number of transverse grid wires less than the number of transverse spring rows embraced by said wire grid, and (b) a number of longitudinal grid wires less than the number of longitudinal spring columns embraced by said wire grid.

7. An improved mattress as set forth in claim 6, each of said wire grids comprising a number of longitudinal grid wires less than the number of longitudinal spring columns embraced by said wire grid.

* * * * *